US005672841A

United States Patent [19]

Monk et al.

[11] Patent Number: 5,672,841

[45] Date of Patent: Sep. 30, 1997

[54] INFLATOR INITIATOR WITH ZENER DIODE ELECTROSTATIC DISCHARGE PROTECTION

[75] Inventors: David B. Monk, Kaysville; Mark B. Woodbury, North Salt Lake; David D. Hansen, Clearfield, all of Utah

[73] Assignee: Morton International, Inc., Chicago, Ill.

[21] Appl. No.: 574,426

[22] Filed: Dec. 15, 1995

[51] Int. Cl.[6] ..... F42B 3/18; F42C 19/12

[52] U.S. Cl. ..... 102/202.4; 102/202.7; 102/202.9; 102/202.1; 361/248

[58] Field of Search ..... 102/202.1–202.14; 280/728.1; 361/247, 248

[56] References Cited

U.S. PATENT DOCUMENTS

| | | | |
|---|---|---|---|
| 2,086,548 | 7/1937 | Handforth | 102/202.4 |
| 2,408,125 | 9/1946 | Rolfes | 361/248 |
| 2,974,590 | 3/1961 | Ramer | 102/202.4 |
| 3,100,447 | 8/1963 | Betts | 102/202.4 |
| 3,318,243 | 5/1967 | Miller | 102/202.4 |
| 3,640,224 | 2/1972 | Petrick et al. | 102/202.2 |
| 4,061,088 | 12/1977 | Ueda | 102/202.4 |
| 4,103,619 | 8/1978 | Fletcher et al. | 361/248 |
| 4,261,263 | 4/1981 | Coultas et al. | 102/202.7 |
| 4,306,499 | 12/1981 | Holmes | 102/202.4 |
| 4,422,381 | 12/1983 | Barrett | 102/202.2 |
| 4,441,427 | 4/1984 | Barrett | 102/202.6 |
| 4,517,895 | 5/1985 | Rucker | 102/202.2 |
| 4,967,665 | 11/1990 | Baginski | 102/202.2 |
| 5,036,768 | 8/1991 | Dow et al. | 102/202.2 |
| 5,140,906 | 8/1992 | Little, II | 102/202.14 |
| 5,200,574 | 4/1993 | Cunningham et al. | 102/530 |
| 5,241,910 | 9/1993 | Cunningham et al. | 102/530 |
| 5,243,911 | 9/1993 | Dow et al. | 102/202.2 |
| 5,279,225 | 1/1994 | Dow et al. | 102/202.2 |
| 5,309,841 | 5/1994 | Hartman et al. | 102/202.4 |
| 5,345,872 | 9/1994 | Takahashi et al. | 102/202.2 |
| 5,353,707 | 10/1994 | Duguet | 102/290 |
| 5,355,800 | 10/1994 | Dow et al. | 102/202.2 |
| 5,367,956 | 11/1994 | Fogle, Jr. | 102/202.2 |
| 5,404,263 | 4/1995 | Graves et al. | 361/247 |
| 5,431,101 | 7/1995 | Arrell, Jr. et al. | 102/202.5 |
| 5,433,147 | 7/1995 | Brede et al. | 102/202.2 |
| 5,454,320 | 10/1995 | Hilden et al. | 102/202.7 |
| 5,544,585 | 8/1996 | Duguet | 102/202.5 |

FOREIGN PATENT DOCUMENTS

| | | | |
|---|---|---|---|
| 510551 | 10/1992 | European Pat. Off. | 102/202.5 |
| 0631104 | 5/1993 | European Pat. Off. . | |
| 2945803 | 5/1981 | Germany | 102/202.5 |
| 3416735 | 11/1985 | Germany | 102/202.5 |
| 960186 | 6/1964 | United Kingdom | 102/202.5 |
| 94/19661 | 9/1994 | WIPO | 102/202.15 |

OTHER PUBLICATIONS

An Electro–Pyrotechnical Initiator May 5, 1993 Translation of EP 0631104.

Vincent J. Menichelli, "A Varistor Technique to Reduce the Hazards of Electrostatics to Electroexplosive Devices", Proceedings of the 8th Symposium on Explosives and Pyrotechnics, Feb. 5–7, 1974.

Quantic Low Cost Initiator (LCI) Date unknown.

SDI Low Cost Pin–Type Initiator Date unknown.

ICI Leadwire Initiator Date unknown.

Toyota Block I (ADI Type).

ICI Hybrid Initiator Date unknown.

*Primary Examiner*—Michael J. Carone

*Assistant Examiner*—Matthew J. Lattig

*Attorney, Agent, or Firm*—Roger J. French; Gerald K. White

[57] ABSTRACT

An initiator with electrostatic discharge protection includes a generally cup-shaped housing having an open end, a quantity of pyrotechnic material in the housing, and a seal for closing the housing open end and encapsulating the pyrotechnic material within the housing. A pair of electrodes in contact with the pyrotechnic material extend through the seal. A zener diode is coupled in electrical circuit between the housing and one of the electrodes to provide a path for electrostatic discharge and to prevent electrostatic discharge from affecting the pyrotechnic material.

11 Claims, 1 Drawing Sheet

INFLATOR INITIATOR WITH ZENER DIODE ELECTROSTATIC DISCHARGE PROTECTION

BACKGROUND OF THE INVENTION

The present invention relates generally to improvements in initiators of the type utilized with inflators for automotive vehicle occupant restraint or airbag systems. More particularly, the invention relates to an initiator having a zener diode to provide electrostatic discharge protection.

Generally speaking, an automotive vehicle occupant restraint system or airbag includes an inflatable cushion and an inflator for providing a quantity of gas for rapidly inflating the cushion at the appropriate time. Such inflators may be of the pyrotechnic type wherein a quantity of pyrotechnic material, once ignited, rapidly produces a quantity of gas for inflating the inflatable cushion. Other types include a so-called hybrid type of initiator wherein a quantity of inflating gas is stored under pressure and supplemented with a quantity of gas produced by a pyrotechnic material. Yet another type of inflator, referred to as a fluid-fueled type, utilizes a quantity of one or more fluid fuels and one or more oxidants to form a volatile mixture which, when activated or energized, will ignite and produce a quantity of gas. In this type of inflator, a quantity of additional pressurized gas may also be provided in a gas storage chamber which, upon ignition of the volatile mixture, will combine with the gas expelled thereby to inflate the inflatable cushion.

The various types of inflator have in common the requirement for an initiator, sometimes called a squib, which is responsive to a pulse of electrical energy, commonly at the 12 volt DC voltage typical of an automotive electrical system, for producing a burst of energy to initiate or begin the process of gas generation and/or release to the inflatable cushion. Typically, this initiator is an electro-explosive device (EED) which contains a quantity of pyrotechnic material having a pair of spaced electrodes embedded therewithin. Typically, the ends of the electrodes embedded within the pyrotechnic material are connected by a relatively thin bridge element which has thermal characteristics selected such that it will rapidly heat to a relatively high temperature when the burst of electrical energy passes therethrough. The heat of this bridge element will ignite the pyrotechnic material within the initiator, providing a rapid burst of energy to trigger or initiate the operation of the inflator device.

In initiators of this type, it is necessary to prevent electrostatic energy, which may build on the external housing or header, from discharging through the pyrotechnic to ground, causing inadvertent deployment of the initiator. Moreover, even if the energy discharged in this way is not sufficient to deploy or fire the initiator, it can cause dielectric tunneling in the pyrotechnic material, resulting in carbonizing, or an oxidizer rich zone of to form around the electrodes and/or bridge element. This material will act generally as a heat insulator, preventing the heat of the bridge element from adequately reaching the pyrotechnic, which may compromise or even prevent adequate firing of the device when desired, thus resulting in a "dud" or reject initiator. Such electrostatic charges commonly occur on the outer surface of the initiator during the manufacture, assembly and handling of the initiator devices, prior to their assembly with an inflator device. In so-called coaxial type initiators, only a single electrode or lead enters the pyrotechnic, with a "header" acting as the other electrode. In this case, electrostatic discharge may be provided by coupling the header to ground and operating in a polarity wherein the firing current is passed from the internal electrode through the pyrotechnic to the grounded header.

However, in the case of two-pin or two-electrode initiators, a number of other arrangements have been utilized to try to provide such a discharge path for electrostatic energy. One such arrangement includes a shunt element such as a bridge wire, a quantity of silver epoxy, a conductive link or a spark gap provided between one of the electrodes and an internal surface of the outer housing. Typically, this shunt element may connect to an internal surface of a sleeve which is interposed intermediate to an external housing or charge cup and a glass header or other seal which encapsulates the pyrotechnic material and the ends of the electrodes in contact therewith within the housing or header. However, such an initiator is more difficult and expensive to construct.

Moreover, most of these alternatives will also allow the firing energy to flow to ground unless some additional secondary insulation is provided. In the event of the insulation resistance failure of such secondary insulation, the device may fail to fire, due to the firing pulse being drawn off through this additional ground path. Or, if the polarity of the device is altered, such that the discharge path is provided to the energized or "hot" pin or electrode rather than the ground pin, an insulation resistance failure could result in inadvertent firing or deployment of the device.

Yet other arrangements provide complete electrical isolation of the charge cup or housing, for example, by providing insulation for the external surfaces of the housing and insulation between the housing and the electrode(s). As an additional matter, most applications also require some minimum insulation resistance, typically on the order of 500 volts between the charge cup or housing and the electrodes. Bridge wires, conductive epoxies or other conductive links and spark gaps must be carefully specified and assembled in order to provide a specific insulation resistance requirement. This adds to the complexity and expense of such an initiator.

OBJECTS AND SUMMARY OF THE INVENTION

Accordingly, it is a general object of this invention to provide electrostatic discharge protection for an initiator which overcomes the above-noted problems.

A further object is to provide such electrostatic discharge protection which allows electrostatic energy to flow from the outside surfaces of the initiator to ground without affecting the pyrotechnic material.

A related object is to provide such electrostatic discharge protection which eliminates the need for complete electrical isolation.

Another object is to provide such electrostatic discharge protection which allows energy to flow only in one direction, thereby preventing energy from flowing to ground during the firing pulse.

Briefly, and in accordance with the foregoing objects, an initiator with electrostatic discharge protection comprises a generally cup-shaped housing having an open end; a quantity of pyrotechnic material in said housing; sealing means for closing said housing open end and encapsulating said pyrotechnic material within said housing; a pair of electrodes in contact with pyrotechnic material and extending through said sealing means; and a zener diode coupled in electrical circuit between said housing and one of said electrodes to provide a path for electrostatic discharge and to prevent electrostatic discharge from affecting said pyrotechnic material.

BRIEF DESCRIPTION OF THE DRAWINGS

The features of the present invention which are believed to be novel are set forth with particularity in the appended claims. The organization and manner of operation of the invention, together with further objects and advantages thereof may best be understood by reference to the following description, taken in connection with the accompanying drawings in which like reference numerals identify like elements, and in which:

DESCRIPTION OF THE ILLUSTRATED EMBODIMENT

Figure 1:
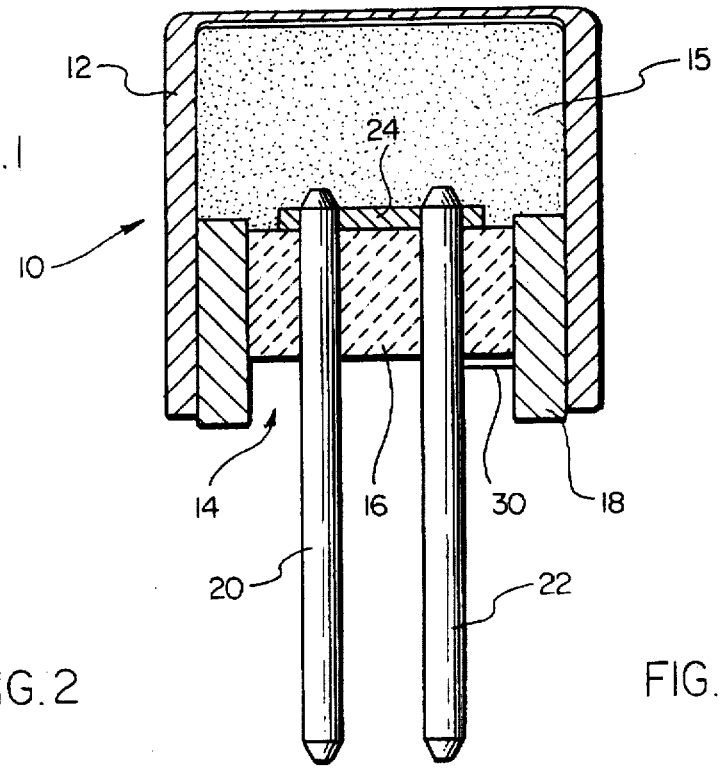
FIG. 1 is a longitudinal sectional view through an initiator, somewhat diagrammatic in form, illustrating electrostatic discharge protection in accordance with the invention.
Figure 2:
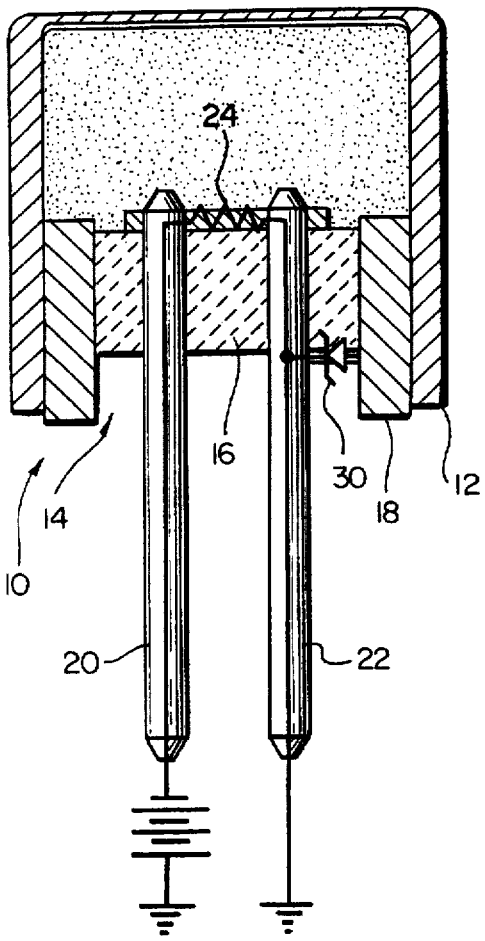
FIG. 2 is a view similar to FIG. 1 showing an equivalent electrical circuit superimposed upon the elements of FIG. 1.

Referring now to the drawings and initially to FIGS. 1 and 2, an initiator is designated generally by the reference numeral 10. This initiator 10 is provided with a novel form of electrostatic discharge protection in accordance with the invention, as will be more fully described hereinbelow.

Generally speaking, the initiator 10 includes a generally cup-shaped housing 12 which has an open end 14. A sealing means such as a glass seal 16 is provided for normally enclosing the open end 14 of the housing 12 and encapsulating a quantity of pyrotechnic material 15 which is contained within the cup-shaped housing 12. This pyrotechnic material may comprise one of a number of materials which when heated will produce a rapid burst of energy, for example, for use in an inflator device for an automotive vehicle occupant restraint system. A number of such pyrotechnic materials are well known in the art.

In the illustrated embodiment, the open end 14 of the housing 12 is sealed by a quantity of electrically non-conductive glass material 16 and a metal header 18. The housing 12 is of an electrically conductive metallic material, and an additional intermediate generally cylindrical header 18 of electrically conductive material, and preferably material similar to that of the housing 12, is interposed between an inner surface of housing 12 and an outer surface of the sealing material 16. In the illustrated embodiment, the housing 12 and header 18 are constructed of, but are not limited to, stainless steel material.

A pair of electrodes 20, 22 extend through the glass seal 16 and into the pyrotechnic material 15 encapsulated within the housing 12. The glass or other material forming the seal 16 may be poured or otherwise introduced following the placement of the electrodes 20 and 22 within the header cylinder 18 in the housing 12. Thus, the electrodes 20 and 22 extend back outwardly of the encapsulated pyrotechnic material through the now sealed open end 14 of the housing 12 for electrical contact with appropriate electrical circuit elements for firing or energizing the pyrotechnic material 15 by introducing an electrical pulse through a circuit including the electrodes 20 and 22.

Figure 3:
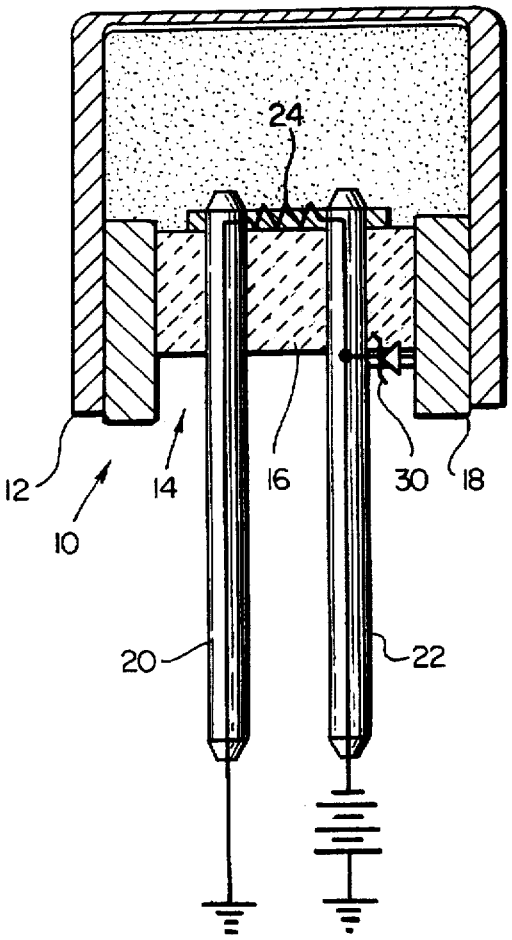
FIG. 3 is a view similar to FIG. 2 illustrating a reverse polarity of the equivalent electrical circuit.

Referring to FIGS. 2 and 3, two such electrical circuits (of opposite polarity) are illustrated in simplified form. In order to energize or fire the pyrotechnic material 15 in response to an electrical pulse introduced by way of electrodes 20 and 22, a bridge element 24 is provided embedded in the pyrotechnic material 15 and electrically coupled between the ends of the electrodes 20 and 22. Preferably, this bridge element 24 has thermal resistive characteristics such that it will rapidly heat in response to an electric current or a firing pulse delivered through the electrodes 20 and 22. The heat energy of the bridge element 24 will normally deploy the pyrotechnic material 15. Thus, in FIGS. 2 and 3 the bridge element 24 is represented electrically by a resistor element.

In accordance with the invention, in order to provide a path for electrostatic discharge protection, a zener diode 30 is coupled in electrical circuit between the housing 12 through the header 18 and one of the electrodes 20 and 22. It will be noted that this arrangement also protects this electrostatic discharge from affecting the pyrotechnic material. The zener diode 30 is interposed in a position extending between an inner surface of the header 18 and one of the electrodes 20 and 22. Preferably, the zener diode 30 is of the surface mount technology (SMT) type and thus comprises a relatively compact, flat element, which advantageously is also a relatively simple, low cost and robust device. This relatively flat SMT zener diode 30 is mounted in the illustrated embodiment between an inner surface of the header 18 and the electrode 22, which as will be seen in FIGS. 2 and 3 may be either coupled with ground or coupled with the energizing potential for firing the initiator 10, here symbolically shown as a battery. As also best viewed in FIGS. 2 and 3, the anode of the zener diode 30 is electrically coupled with the housing 12, by way of the header 18, while its cathode electrode is electrically coupled with the electrode 22 of the initiator 10.

Also, to avoid any contact with or disturbance of the pyrotechnic material 15 and also to simplify the assembly of the initiator 10, the zener diode 30 is mounted to an outer surface of the glass seal 16. In this regard, the glass seal 16 has oppositely facing surfaces, one of which faces generally into the encapsulated portion of the housing 12 and one of which generally faces oppositely, that is, toward the open end 14 of the housing 12.

The zener diode 30 may be selected or specified to have a forward breakdown voltage at least as great as the firing voltage of the initiator 10, which in most automotive applications is 12 volts. In cases where there is a required insulation resistance between the housing 12 and the electrodes 20, 22 the zener diode 30 may be selected to have a forward breakdown voltage at least as reat as this insulation resistance. In many cases the insulation resistance is specified as a test voltage, typically 500 volts.

Accordingly, the present invention provides a path to ground for electrostatic energy, wherein this energy runs through a zener diode 30 rather than through the pyrotechnic material 15. It will be appreciated that typical electrostatic charge voltages are on the order of 6,000 to 25,000 volts. Thus, the zener diode 30 provides a path to ground for electrostatic energy, which protects the initiator 10 from inadvertent deployment due to electrostatic discharge through the pyrotechnic. Moreover, this arrangement prevents the electrostatic discharge from adversely affecting the pyrotechnic material. That is, with this arrangement, energy is not passed through the pyrotechnic material, which as mentioned above, can cause carbonizing of the material. Moreover, this arrangement prevents the loss of normal firing energy when it is applied. Advantageously, as noted above, the SMT zener diode 30 comprises a simple, low cost and robust device.

While particular embodiments of the invention have been shown and described in detail, it will be obvious to those skilled in the art that changes and modifications of the present invention, in its various aspects, may be made without departing from the invention in its broader aspect, some of which changes and modifications being matters of routine engineering or design, and others being apparent only after study. As such, the scope of the invention should not be limited by the particular embodiments and specific constructions described herein but should be defined by the appended claims and equivalents thereof. Accordingly, the aim in the appended claims is to cover all such changes and modifications as fall within the true spirit and scope of the invention.

The invention is claimed as follows:

1. An initiator with electrostatic discharge protection comprising: a generally cup-shaped housing having an open end and containing pyrotechnic material; sealing means for closing said housing open end and encapsulating said pyrotechnic material within said housing; a pair of electrodes in contact with said pyrotechnic material and extending through said sealing means; and a zener diode coupled in electrical circuit between said housing and one of said electrodes to provide a path for electrostatic discharge and to prevent electrostatic discharge from adversely affecting said pyrotechnic material; wherein said zener diode comprises a discrete component mounted to said initiator in a position extending between an inner surface of said housing and said one of said electrodes, and has an anode electrode electrically in series with said housing and a cathode electrode electrically in series with said one electrode of said initiator.

2. An initiator according to claim 1 wherein said sealing means comprises sealing material extending across said open end of said housing for encapsulating said electrodes and said pyrotechnic material, said sealing material defining oppositely facing surfaces, one surface facing inwardly of said housing and one surface facing outwardly of said housing; and wherein said zener diode is of the surface mount type and is mounted to one of said oppositely facing surfaces of said sealing material.

3. An initiator according to claim 2 wherein said zener diode is mounted to the surface of the sealing material facing outwardly of said housing.

4. An initiator according to claim 1 wherein said zener diode has a forward breakdown voltage at least as great as the firing voltage of the initiator.

5. An initiator according to claim 1 wherein said zener diode has a forward breakdown voltage at least as great as any required insulating resistance between said housing and said electrodes.

6. An initiator according to claim 1 wherein said housing comprises a conductive metallic cup member and further including a header of conductive material interposed between said housing and said sealing means; wherein said sealing means comprises sealing material extending across said header and encapsulating said electrodes and said pyrotechnic material within said housing and defining a pair of oppositely facing surfaces, one said surface facing the interior of said housing and one said surface facing in the direction of said housing open end, and wherein said zener diode is mounted to one of said surfaces of said sealing material.

7. An initiator according to claim 6 wherein said zener diode has an anode electrically coupled to said header and a cathode electrically coupled to said one electrode of said initiator.

8. An initiator according to claim 6 wherein said zener diode is of the surface mount type and is mounted against the surface of said sealing material which faces in the direction of the open end of said housing.

9. An initiator according to claim 6 wherein said zener diode is electrically connected between said header and said one electrode.

10. An initiator with electrostatic discharge protection comprising: a generally cup-shaped housing having an open end and containing pyrotechnic material; sealing means for closing said housing open end and encapsulating said pyrotechnic material within said housing; a pair of electrodes in contact with said pyrotechnic material and extending through said sealing means; and a zener diode coupled in electrical circuit between said housing and one of said electrodes to provide a path for electrostatic discharge and to prevent electrostatic discharge from adversely affecting said pyrotechnic material; wherein said sealing means comprises sealing material extending across said open end of said housing for encapsulating said electrodes and said pyrotechnic material, said sealing material defining oppositely facing surfaces, one surface facing inwardly of said housing and one surface facing outwardly of said housing; and wherein said zener diode is of the surface mount type and is mounted to one of said oppositely facing surfaces of said sealing material, extending between an inner surface of the housing and said one of said electrodes.

11. An initiator with electrostatic discharge protection comprising: a generally cup-shaped housing having an open end and containing pyrotechnic material; sealing means for closing said housing open end and encapsulating said pyrotechnic material within said housing; a pair of electrodes in contact with said pyrotechnic material and extending through said sealing means; and a zener diode coupled in electrical circuit between said housing and one of said electrodes to provide a path for electrostatic discharge and to prevent electrostatic discharge from adversely affecting said pyrotechnic material; wherein said sealing means comprises sealing material extending across said open end of said housing for encapsulating said electrodes and said pyrotechnic material, said sealing material defining oppositely facing surfaces, one surface facing inwardly of said housing and one surface facing outwardly of said housing; and wherein said zener diode is of the surface mount type and is mounted to said surface of said sealing material facing outwardly of said housing, extending between an inner surface of the housing and said one of said electrodes.

* * * * *